US006219026B1

(12) United States Patent
Dijkstra

(10) Patent No.: US 6,219,026 B1
(45) **Date of Patent: *Apr. 17, 2001**

(54) DISPLAY DEVICE

(75) Inventor: Hendrik Dijkstra, Eindhoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/859,800

(22) Filed: May 19, 1997

(30) Foreign Application Priority Data

May 17, 1996 (EP) ..... 96201393

(51) Int. Cl.[7] ..... G09G 5/36
(52) U.S. Cl. ..... 345/138
(58) Field of Search ..... 345/138, 139, 345/199, 501, 507; 382/272, 298

(56) References Cited

U.S. PATENT DOCUMENTS

| | | | | |
|---|---|---|---|---|
| 4,631,690 | * | 12/1986 | Corthout et al. | 395/120 |
| 4,736,248 | * | 4/1988 | Rosebrock | 348/441 |
| 4,769,771 | * | 9/1988 | Lippmann et al. | 395/200.43 |
| 4,812,988 | * | 3/1989 | Duthuit et al. | 395/125 |
| 4,924,415 | * | 5/1990 | Winser | 395/122 |
| 4,991,112 | * | 2/1991 | Callemyn | 711/106 |
| 4,992,780 | * | 2/1991 | Penna et al. | 345/139 |
| 5,008,752 | * | 4/1991 | Van Nostrand | 358/160 |
| 5,055,997 | * | 10/1991 | Sluijter et al. | 710/132 |
| 5,068,646 | * | 11/1991 | Baker | 345/122 |
| 5,103,311 | * | 4/1992 | Sluijter et al. | 348/571 |
| 5,109,488 | * | 4/1992 | Dijkstra et al. | 711/201 |
| 5,134,688 | * | 7/1992 | Corthout | 395/142 |
| 5,199,082 | * | 3/1993 | Venema | 382/199 |
| 5,280,620 | * | 1/1994 | Slujiter et al. | 395/800.15 |
| 5,317,684 | * | 5/1994 | Penna | 345/194 |
| 5,384,912 | * | 1/1995 | Ogrinc et al. | 395/523 |
| 5,394,516 | * | 2/1995 | Winser | 395/119 |
| 5,402,513 | * | 3/1995 | Schafer | 382/298 |
| 5,452,376 | * | 9/1995 | Ramirez et al. | 382/274 |
| 5,488,307 | * | 1/1996 | Plott | 324/555 |
| 5,544,292 | * | 8/1996 | Winser | 395/130 |
| 5,689,343 | * | 11/1997 | Loce et al. | 358/298 |
| 5,838,334 | * | 11/1998 | Dye | 345/503 |
| 5,898,507 | * | 4/1999 | Nakane et al. | 358/448 |

OTHER PUBLICATIONS

"Color Coding Stereo Pairs for Non–Interlaced Display" By P. Chesnais and W. Plesnaik, Published in 1988, pp. 114–118 of the Proceedings of the SPIE vol. 901 "Image Processing, Analysis, Measurement, and Quality" (G.W. Hughes, P.E. Mantey, B.E. Rogowitz, Editors).

* cited by examiner

*Primary Examiner*—Amare Mengistu
(74) *Attorney, Agent, or Firm*—Gregory L. Thorne

(57) ABSTRACT

An image display device wherein pixel drive values are generated on the basis of digital information words. Each information word is translated twice, using a look-up table, first to obtain a drive value for a relevant pixel and then to obtain a drive value for a direct neighbor of that pixel. The pixels may be in successive fields of an interlaced image, in which case the content of the look-up table is replaced between the two translations so as to correspond with the respective interlaced fields. The content of the look-up table for the first pixel provides only a limited range of possible pixel drive values, whereas the content of the table for neighboring pixels provides a broader range of pixel drive values corresponding to interpolations between pairs of drive values in the limited range.

7 Claims, 1 Drawing Sheet

DISPLAY DEVICE

The invention relates to an image display device, including an input for receiving an image information item, an expansion unit for expanding the image information item into a first and a second pixel drive item, which expansion unit has a general range of available pixel drive values from which it takes the first pixel drive item dependent on the image information item and a dependent range of available pixel drive values from which it takes the second pixel drive item dependent on the image information item, the dependent range being dependent on the actual pixel drive value of the first pixel drive item, and a display panel which produces a first and a second pixel reproduction under the control of the first and the second pixel drive item, respectively.

DISCUSSION OF RELATED ART

An image display device of this kind is known from an article by P. Chesnais and W. Plesniak: "Color coding stereo pairs for non-interlaced display", published in 1988, pp. 114 to 118 of the proceedings of the SPIE volume 901 "Image Processing, Analysis, Measurement, and Quality" (G. W Hughes, P. E. Mantey, B. E. Rogowitz, editors).

The device described in the cited publication generates a stereo pair, that is to say a first image for viewing by the right eye and a second image for viewing by the left eye. The display panel produces the light alternately for the right eye and the left eye. An image information item represents a light intensity for both eyes and serves as an index in a table of color pairs. A first component of the indexed color pair serves as the first pixel drive item for use in the image for the right eye and, the second component of this color pair serves as the second pixel drive item for use in the image for the left eye.

Using a look-up table, the image information item is converted into the first pixel drive item. The content of the look-up table is replaced in the blanking interval between successive images. Subsequently, the image information item is converted into the second pixel drive item by means of the look-up table. The look-up table thus serves for converting the image information item alternately into the first and the second pixel drive item for the image for the right eye and the left eye, respectively.

The information content of the image information item is less than the sum of the individual information content of the first and the second pixel drive item. Because of the correlation between the images for the two eyes, however, images without disturbing artefacts can nevertheless be generated for both eyes.

However, strong correlations also exist between spatially neighbouring pixels in a single image. That aspect, however, is not mentioned in the publication by P. Chesnais et al.

SUMMARY OF THE INVENTION

It is inter alia an object of the invention to provide image display control in which the amount of information required for controlling the content of an image is limited.

To this end, the display device according to the invention is characterized in that the display panel produces the first and the second pixel reproduction on a first and a second pixel which are direct neighbours. The correlation between the values of pixel drive items for neighbouring pixels is thus utilized. The amount of information required to control neighbouring pixels with minimum artefacts is less than the sum of the individual amounts of information required for individual driving of the pixels. Thus, on average less information is required per pixel.

An embodiment of the display device according to the invention is arranged to display successively a first and a second raster of image lines in a spatially interlaced fashion, the first and the second pixel being associated with the first and the second raster, respectively. An ample period of time thus elapses between the generation of the first and the second pixel drive item. Consequently, the expansion unit can be readily switched over so that it successively generates the first and the second pixel drive item.

The expansion unit in an embodiment of the display device according to the invention includes a look-up table for deriving a look-up signal from the image information item in conformity with a programmable relation, and also includes programming means for reprogramming the programmable relation between the display of the first and the second raster, the expansion unit forming the first and the second pixel drive item from the look-up signal in the same way, except for the reprogramming, before and after the reprogramming, respectively. The ample period of time elapsing between the generation of the first and the second pixel drive item is thus used to reprogram the look-up means. Thanks to the reprogramming, no additional hardware facilities are required for generating the two pixel drive items.

The dependent range in an embodiment of the display device according to the invention is limited essentially to interpolated values, each interpolated between a respective pixel drive value from the general range and the actual pixel drive value.

In given applications the value of a part of the pixel drive items is obtained by interpolation between the values of neighbouring pixel drive items. This is the case, for example when an image is displayed on an image display panel suitable for a resolution higher than that specified for the image.

If the pixel drive items wherebetween interpolation takes place can only assume a limited number of N pixel drive values, for example N=16 different color values, in the case of linear interpolation the number of feasible pixel drive values for the interpolated pixel drive items will be comparatively higher (generally $N(N+1)/2$ if the interpolations between different color values do not coincide anywhere). If this value were individually coded, the amount of information required would be greater than that required for the coding of the values of the pixel drive items wherebetween interpolation takes place.

According to the invention, however, the amount of information required is limited by utilizing the knowledge of the actual value of at least one of the pixel drive items wherebetween interpolation takes place. This is advantageous notably in the case of interlacing where the image lines of one raster are formed by interpolation of the image lines of the other raster, because in this manner annoying line flicker is prevented.

Interpolation in the display device according to the invention corresponds to averaging. Therefore, in such an embodiment of the display device according to the invention each interpolated value corresponds to a mean value of the respective pixel drive value from the general range and the actual pixel drive value.

The invention is used preferably for pixel drive values controlling different color tones.

BRIEF DESCRIPTION OF THE DRAWINGS

These and other aspects of the invention will be described in detail hereinafter with reference to some Figures.

DETAILED DESCRIPTION OF THE PREFERRED EMBODIMENTS

Figure 1:
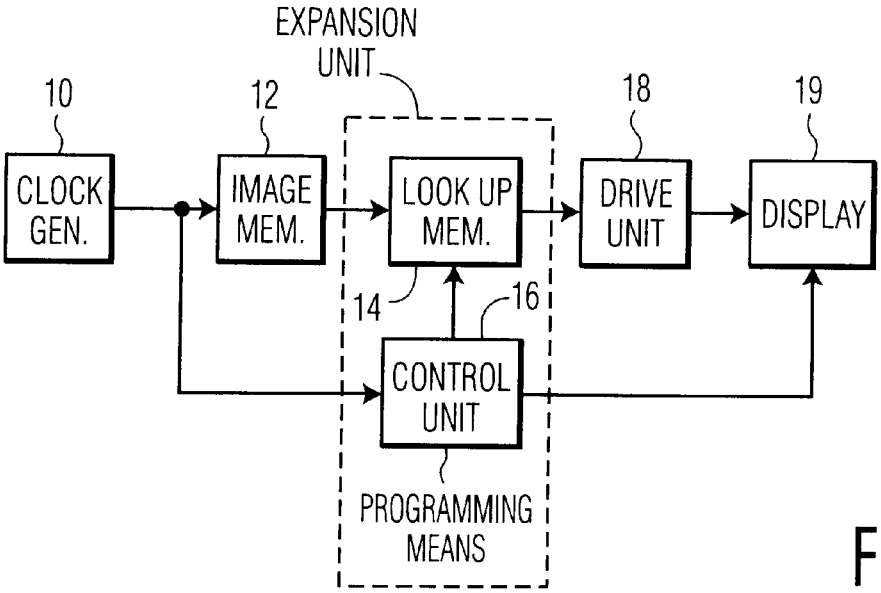
FIG. 1 shows an image display device.

FIG. 1 shows an image display device. The device includes a cascade connection of a clock generator 10, an image memory 12, a look-up memory 14, a display panel drive unit 18, and a display panel 19. The clock generator 10 is also coupled to a control unit 16 which controls the look-up memory 14 and the display screen drive unit 18.

During operation, the display device displays an image on the display panel 19 which is, for example a CRT monitor. The content of the image is represented by image information items, for example 8-bit words, which are stored in the image memory 12. Under the control of a clock signal from the clock generator 10, the image memory 12 reads the image information items from different locations for successive supply to the look-up memory 14. The look-up memory 14 contains a number of pixel drive items which are, for example 3×8-bit RGB words (8 bits Red, 8 bits Green, 8 bits Blue). Each image information item serves as an index in the look-up memory 14 and selects a pixel drive item stored in the look-up memory 14. The look-up memory 14 applies the selected pixel drive item to the display panel drive unit 18 which drives the display panel 19 in conformity with the relevant pixel drive item. The display panel 19 displays an image containing pixels, for example 256×256 pixels. On the basis of the clock signal, the control unit 16 determines the pixel of the display panel 19 in which the pixel drive item is reproduced and controls the display panel 19 accordingly.

Figure 2:
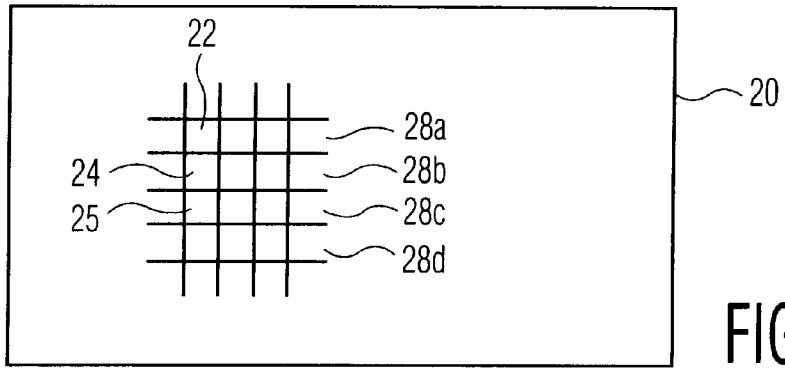
FIG. 2 shows a number of pixels in an image.

FIG. 2 shows an image 20 with a number of pixels 22, 24, 25, arranged on image lines 28*a–c* of four successive image lines 28*a–d*. According to the invention, two neighbouring pixels, for example a first pixel 22 and a second pixel 24, are derived from the same image information item.

The information content of the image information item is then less than the sum of the individual information contents of the two pixel drive items. This means that, if the image information item can have M different values and if the first and the second pixel drive item per se can in principle have $M_1$ and $M_2$ values, the product of $M_1$ and $M_2$ is larger than M ($M_1M_2>M$). This will be illustrated hereinafter on the basis of an example. The example in FIG. 3 shows a number of combinations of pixel drive values $V_1$, $V_2$ which can be assumed by the first and the second drive item, respectively (the coordinate axes for $V_1$ and $V_2$ are shown exclusively for the purpose of illustration; they do not correspond to the zero value).

Figure 3:
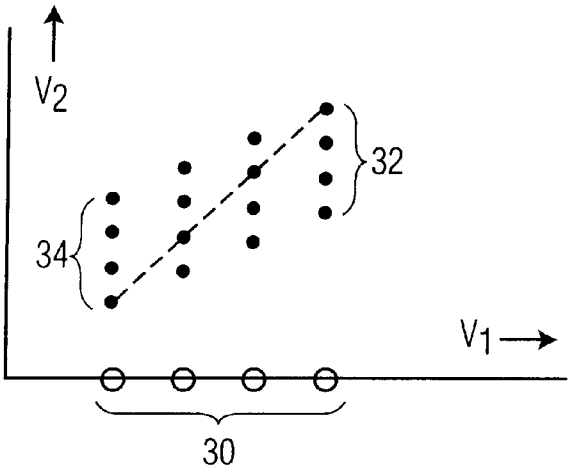
FIG. 3 shows a number of combinations of pixel drive values.

FIG. 3 is based on the assumption that the pixel drive items for the even lines 28*a*, 28*c* of the image 20 can assume $M_1=4$ different values $V_1$ for the control of a grey level. The example is also based on the assumption that the value $V_2$ of a pixel drive item for a pixel 24 on an odd line 28*b*, lines is the mean value of the two pixel drive items for the pixels 22, 25 in the same position on the adjoining even lines 28*a*, 28*c*. Therefore, a total of $M_2=7$ values $V_2$ are feasible for a pixel drive item for a pixel 24 on an odd line 28*b*, which is more than for a pixel on the even lines 28*a*, 28*c*.

The value of the pixel drive item for a pixel 24 on an odd line 28*b*, however, is dependent on the value $V_1$ of the pixel drive item for the pixel 22 in the same position on the adjoining even line 28*a*. FIG. 3 shows the combinations of $V_1$, $V_2$ values which can thus occur. The pixel drive items for the pixels 22, 25 on the even lines 28*a*, 28*c* originate from a general range 30. The range 32, 34 of pixel drive values $V_2$ that can be assumed by a pixel drive item for a pixel 24 on the odd line 28*b* is dependent on the actual value $V_1$ of the pixel drive item for the neighbouring pixel 22 on the neighbouring even line 28*a*.

Encoding of the first and second pixel drive items individually would require 5 bits ($\log_2 4+\log 7_2$). An image information item which controls the two pixel drive items simultaneously need only comprise four bits (two bits for selection from the general range 30 and two bits for selection from the dependent range 32, 34).

Even though FIG. 3 illustrates this principle for grey values, it can be used equally well for pixel drive items for color values. In the case of a general range of $M_1$ different color values, $M_2=M_1(M_1+1)/2$ mean values are possible in principle. If a concrete color value of the drive item in a neighbouring pixel is known, only a dependent range of $M_1$ color values then remains.

The values of the first and the second pixel drive item are coded together in an image information item. This image information item is translated twice by means of the look-up memory 14. The amount of storage space required in the image memory 12 is thus reduced.

An image information item is stored, for example for each pair of pixels 22, 24 on two neighbouring lines 28*a*, 28*b*. This image information item is always read twice: once for translation into the first pixel drive item for the pixel 22 on the even line 28*a* and once for translation into the second pixel drive item for the pixel 24 on the odd line 28*b*. The image information item contains, for example a combination of a code for the value of the pixel 22 on the even line 28*a* and a code for the value of the pixel 25 on the subsequent even line. For example, such a combination can be stored as an image information item in a location of the image memory 12 for each pixel of each even line.

Alternatively, for each pixel of each even line only the code for the value of the pixel itself is stored. For the generation of the pixel drive item for a pixel of an odd line the codes of this combination are read from different memory locations and applied together to a look-up table. This alternative requires less storage space, but imposes more complex addressing of the image memory 12.

The translation utilizes two look-up tables, one for the translation of the image information item into the first pixel drive item and one for the translation of the image information item into the second pixel drive item. The look-up tables in the look-up memory 14 can be reloaded, for example intermediately. To this end, the control unit 16 always loads, for example after completion of a line, the appropriate table into the look-up memory in order to translate the image information items into pixel drive items for the relevant line. Alternatively, the two tables can be simultaneously stored in the look-up memory. The control unit 16 then generates a selection signal which determines which table is to be used for the translation.

Instead of the look-up memory 14, use can also be made of a logic array which provides the same input/output relation as the look-up memory when loaded with the appropriate tables.

The display device can be advantageously used notably if the raster of the even lines 28*a*, 28*c* and the raster of the odd lines 28*b*, 28*d* are successively displayed (so first 28*a*, 28*c* etc. and subsequently 28*b*, 28*d* etc., or vice versa). This kind of display may give rise to so-called line flicker if the image intensity of the pixels 24 on the odd lines 28*b*, 28*d* is not equal to the mean value of the adjoining pixels 22, 25 on the even lines 28*a*, 28*c*.

In order to prevent line flicker, the value of the pixel drive item for the pixel 24 on the odd line 28*b* is made equal to a mean value of the values of the pixel drive items for the neighbouring pixels 22, 25 on the neighbouring even lines 28*a*, 28*c*. This is realized as described above. The appropriate table can then be loaded into the look-up memory 14 each time after completion of the translation of a raster of image lines. The frequency at which new tables are loaded into the look-up memory, therefore, is much lower than the pixel frequency. If necessary, the mean values used are compensated for gamma correction: the content of the look-up table is chosen so that the generated image intensity of the pixel 24 on the odd line 28*b* equals the mean image intensity of the neighbouring pixels 22, 25.

Line flicker can thus be prevented, for example upon display of teletext characters for which only a limited general range of colors is used.

What is claimed is:

1. An image display device comprising:

an image memory for storing image information items;

an expansion unit for expanding each image information item into a first and a second pixel drive item, the first pixel drive item being taken from a general range of available pixel drive values and the second pixel drive item being taken from a dependent range of available pixel drive values, the dependent range being solely dependent on the first pixel drive item; and a display panel for displaying reproductions of a first and a second pixel in accordance with the first and the second pixel drive items respectively, the first and second pixels being direct neighbors of each other.

2. A display device as claimed in claim 1, for successively displaying first and second rasters of image lines which are spatially interlaced, the first and second pixels respectively being associated with the first and second rasters.

3. A display device as claimed in claim 2, in which the expansion unit comprises:

a look-up table for deriving pixel drive values from image information items in accordance with a programmable relation there-between; and programming means for reprogramming said programmable relation during a time interval between the displays of the first and second rasters;

and wherein the expansion unit forms the first and the second pixel drive items from the look-up table respectively before and after said reprogramming.

4. A display device as claimed in claim 1, in which the dependent range of pixel drive values is limited essentially to values interpolated between a respective pixel drive value from the general range and the actual pixel drive value of the first pixel drive item.

5. A display device as claimed in claim 4, in which each interpolated value corresponds to a mean value of a respective pixel drive value from the general range and the actual pixel drive value.

6. A display device as claimed in claim 1, in which the display panel is a color display panel and the general range contains pixel drive values for a plurality of mutually different color tones.

7. A method of producing a display of an image, comprising the steps of:

expanding an image information item into a first and a second pixel drive item, said expansion being obtained from a general range of available pixel drive values which includes the first pixel drive item and a dependent range of pixel drive values which includes the second pixel drive item, the selection of the dependent range being dependent on first pixel drive item; and using the first and second pixel drive to produce on a display panel reproductions of a first and a second pixel which are direct neighbors of each other.

* * * * *